US005673623A

United States Patent [19]

Schmid

[11] Patent Number: 5,673,623

[45] Date of Patent: Oct. 7, 1997

[54] DEVICE FOR HOLDING A PRINTING MASTER WITHOUT SLIPPAGE ON AN OUTER CYLINDRICAL SURFACE

[75] Inventor: Gotthard Schmid, Malsch, Germany

[73] Assignee: Heidelberger Druckmaschinen AG, Heidelberg, Germany

[21] Appl. No.: 532,168

[22] Filed: Sep. 22, 1995

[30] Foreign Application Priority Data

Sep. 24, 1994 [DE] Germany ..... 44 34 150.4

[51] Int. Cl.[6] ..... B41F 27/12

[52] U.S. Cl. ..... 101/415.1; 101/407.1

[58] Field of Search ..... 101/407.1, 409, 101/415.1, 389.1, 410, 411; 451/499, 500

[56] References Cited

U.S. PATENT DOCUMENTS

| | | | |
|---|---|---|---|
| 1,282,922 | 10/1918 | Novotny | 101/415.1 |
| 1,675,000 | 6/1928 | Spence | 101/412 |
| 3,568,596 | 3/1971 | Mashburn | 101/415.1 |
| 3,908,546 | 9/1975 | Porter | 101/415.1 |
| 4,076,183 | 2/1978 | Kingsley | 242/538.3 |
| 4,231,652 | 11/1980 | Moser et al. | 355/3 |
| 4,769,652 | 9/1988 | Cleary et al. | 346/136 |
| 5,026,045 | 6/1991 | Wirz et al. | 101/415.1 |
| 5,355,795 | 10/1994 | Moss et al. | 101/141 |
| 5,361,697 | 11/1994 | Stellberger | 101/415.1 |
| 5,413,043 | 5/1995 | Fuhrmann et al. | 101/415.1 |
| 5,435,242 | 7/1995 | Kusch et al. | 101/415.1 |

FOREIGN PATENT DOCUMENTS

| | | | |
|---|---|---|---|
| 3614554 | 11/1987 | Germany | 101/415.1 |
| 40 36 252 | 1/1992 | Germany . | |
| 4303872 | 10/1993 | Germany . | |
| 95575 | 7/1980 | Japan | 101/415.1 |
| 402103 | 11/1933 | United Kingdom | 101/389.1 |
| 1545449 | 5/1979 | United Kingdom | 101/415.1 |

*Primary Examiner*—Edgar S. Burr
*Assistant Examiner*—Daniel J. Colilla
*Attorney, Agent, or Firm*—Herbert L. Lerner; Laurence A. Greenberg

[57] ABSTRACT

Printing device for holding a printing master without slippage on an outer cylindrical surface of a form cylinder having, in the interior thereof, a first reel for unwinding a printing master which is mountable on the outer cylindrical surface of the form cylinder, and a second reel for rewinding a printing master which has been mounted on the outer cylindrical surface, the form cylinder being formed with a single opening leading to a cavity provided in the interior thereof, the first and the second reels being disposed in common within the cavity, the printing master being windable from the first reel within the cavity onto the outer cylindrical surface and from the outer cylindrical surface onto the second reel within the cavity, the printing master being movable circumferentially to the outer cylindrical surface, includes a removable form-locking connection between a surface provided on the form cylinder and the tangentially movable printing master for restraining movement of the printing master in one direction.

10 Claims, 2 Drawing Sheets

DEVICE FOR HOLDING A PRINTING MASTER WITHOUT SLIPPAGE ON AN OUTER CYLINDRICAL SURFACE

BACKGROUND OF THE INVENTION

Field of the Invention

The invention relates to a device for holding a printing master without slippage on an outer cylindrical surface and, more particularly, to a printing device on a form cylinder having, in the interior thereof, a first reel for unwinding a printing master which is mountable on the outer cylindrical surface of the form cylinder, and a second reel for rewinding a printing master which has been mounted on the outer cylindrical surface, the form cylinder being formed with a single opening leading to a cavity provided in the interior thereof, the first and the second reels being disposed in common within the cavity, the printing master being windable from the first reel within the cavity onto the outer cylindrical surface and from the outer cylindrical surface onto the second reel within the cavity.

Heretofore known from the state of the prior art exemplified by U.S. Pat. No. 4,231,652, is a drum of a copier having in the interior of which two winding reels, an unwinding reel as well as a rewinding reel. In order to exchange the entire drum when the unwinding reel is exhausted, drum-holding journals are axially movable, so that the entire drum can be removed, instead of having to replace the winding reels in the drum in a time-consuming manner.

U.S. Pat. No. 4,769,652 discloses a device and a process which relate to a continuous supplying of sheet material from the interior of a drum onto the outer cylindrical surface thereof. In order to unwind a supply of material from a reel inside the drum, friction rollers are coupled to an external drive until the outer cylindrical surface of the drum has been provided with a new covering. In order to detach or sever the used covering, the supplying device disclosed in U.S. Pat. No. 4,769,652 is provided with a cross-cutting device which performs this task.

Published German Patent Document DE 43 03 872 A1 discloses a printing device with a form cylinder and a method for preparing the form cylinder for printing. Contained in a cavity of a form cylinder are two winding supply reels, of which one reel accepts the covering which is to be unwound from the circumference of the cylinder while, simultaneously, new material for covering the cylinder is unwound from the other reel. Due to the fulling or flexing work between the printing master on the surface of the form cylinder, on the one hand, the printing master being subjected to tension only by the position of the winding reel, and the surface of the rubber-blanket cylinder on the other hand, during the common rotation, an undesired buckling of the printing master on the circumference of the form cylinder may occur, such buckling exerting no small influence on the printing quality which is produced.

It has further been shown that, in a printing-unit cylinder arrangement wherein the windable supply of printing masters causes an increase in the diameter of the form cylinder, when compared with the diameter of the Schmitz ring or cylinder bearer thereof, and wherein the diameter of the rubber-blanket cylinder with a rubber blanket mounted thereon is equal to or less than the cylinder-bearer diameter, it is not possible to achieve identical circumferential speeds of both printing-unit cylinders. The different circumferential speeds lead to a buckling of the printing-master material, opposite to the direction of rotation. This induces circumferential forces in the printing master which counteract the tensioning forces which are applied by the winding reels and which have already been attenuated by frictional forces on the circumference of the form cylinder.

SUMMARY OF THE INVENTION

In view of the prior art outlined hereinbefore and the indicated technical problem, it is an object of the invention to provide a device for holding a printing master without slippage on an outer cylindrical surface by bringing the printing master or image carrier without undue stretching into printing position and to hold it thereat permanently in position during the printing.

With the foregoing and other objects in view, there is provided, in accordance with the invention, a printing device for holding a printing master without slippage on an outer cylindrical surface of a form cylinder having, in the interior thereof, a first reel for unwinding a printing master which is mountable on the outer cylindrical surface of the form cylinder, and a second reel for rewinding a printing master which has been mounted on the outer cylindrical surface, the form cylinder being formed with a single opening leading to a cavity provided in the interior thereof, the first and the second reels being disposed in common within the cavity, the printing master being Windable from the first reel within the cavity onto the outer cylindrical surface and from the outer cylindrical surface onto the second reel within the cavity, the printing master being movable circumferentially to the outer cylindrical surface, comprising a removable form-locking connection between a surface provided on the form cylinder and the circumferentially movable printing master for restraining movement of the printing master in one direction. In regard to the foregoing, it is noted that a form-locking connection connects two elements together due to the shape of the elements themselves, as opposed to a force-locking connection which locks the elements together by force external to the elements.

In accordance with another feature of the invention, the surface provided on the form cylinder is formed with an imbricated microstructure.

In accordance with a further feature of the invention, the surface provided on the form cylinder is the outer cylindrical surface thereof, the microstructure being formed directly on the outer cylindrical surface of the form cylinder.

In accordance with an alternative feature of the invention, the surface provided on the form cylinder is formed on a foil mountable in a non-slip manner on the outer cylindrical surface of the form cylinder.

In accordance with an added feature of the invention, the microstructure is constructed of projections formed with flat flanks and steep flanks.

In accordance with an additional feature of the invention, the printing master has a rear side formed with a structure which is a reverse of the microstructure.

In accordance with yet another feature of the invention, the rear side of the printing master is formed with recesses defined by steep flanks.

In accordance with yet a further feature of the invention, the printing master has a rear side coated with an elastically deformable material adapting to the microstructure of the outer cylindrical surface of the form cylinder.

In accordance with yet an added feature of the invention, the printing master has a rear side coated with an elastically deformable material adapting to the microstructure of the foil.

In accordance with yet an additional feature of the invention, the printing master has a rear side coated with Teflon or tetrafluoroethylene or the like.

In accordance with a concomitant feature of the invention, the printing master has a rear side provided with a coating having sliding properties which are variable in accordance with a respective load applied to the coating.

The advantages achievable with the device according to the invention are that slippage of the printing master and, therefore, loss of register are not possible, because the shear forces acting on the printing master are absorbed by the form-locking connection. Consequently, relative movement between the printing master and the cylinder surface is prevented. Conversely, however, it is very readily possible for the printing master to be fed forward easily in the unwinding or unreeling direction. The form-locking connection acts like a free-wheeling or over-running clutch which effectively blocks or restrains movement in one direction while permitting movement in another direction. The construction in accordance with the invention additionally provides the advantage that the lateral slipping of the printing master in the case of diagonally offset cylinders is eliminated by the form-locking connection.

In a further development of the device according to the invention, the surface of the form cylinder is provided with an imbricated or shingled microstructure. This microstructure may, for example, have a roughness or $R_z$ equal to 10 to 15 microns. On the one hand, this microstructure may be produced directly on the outer cylindrical surface of the form cylinder, while, on the other hand, it is also possible for a foil provided with a microstructure to be disposed in a non-slip manner on the outer cylindrical surface. The microstructure may be produced by means of an etching process or by a rolling process. In addition, a purposeful shot-peening at an angle to the outer cylindrical surface is suitable for producing a microstructure, and electrodeposition of a microstructure is equally conceivable. A textured chrome surface with a formation of spherical calottes or cups would likewise be a possible way to produce a microstructure.

In a special embodiment, the microstructure may be formed of projections having flat and steep flanks. If the rear side of the printing master is provided with a structure which is a reverse of that of the microstructure formed on the outer cylindrical surface of the form cylinder or the foil applied thereto, the effect of the solution according to the invention is particularly reinforced. If a steep flank on the rear side of the printing master, for example, is in contact with a steep flank on the microstructure of the foil or of the outer cylindrical surface, the shear forces are then completely absorbed. The formation of the rear side of the printing master with a regional Teflon coating would likewise be possible, and it would also be possible for the rear side of the printing master to be coated with a material which is elastically deformable and adapts to the microstructure. Consequently, assurance would be provided that buckling would be optimally restrained in every position, depending upon the winding position of the printing master on the outer cylindrical surface of the form cylinder.

Conversely, the rear side of the printing master might also be coated with a material having sliding properties which vary in accordance with a corresponding variation in the loading which is applied.

Other features which are considered as characteristic for the invention are set forth in the appended claims.

Although the invention is illustrated and described herein as embodied in a device for holding a printing master without slippage on an outer cylindrical surface, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
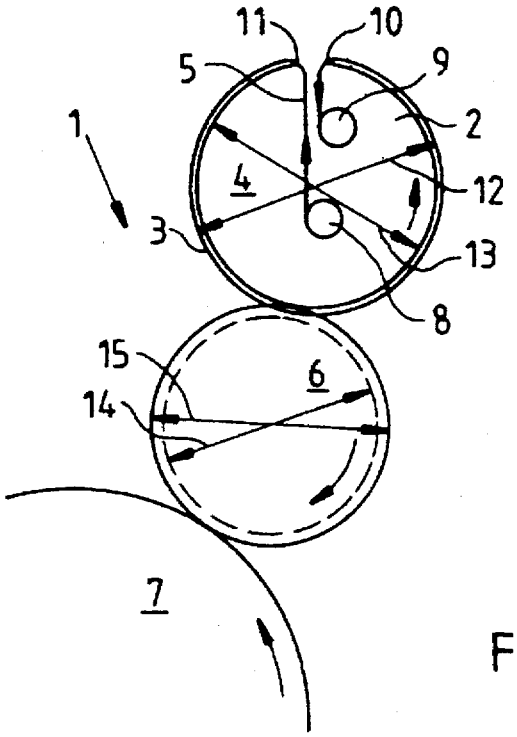
FIG. 1 is a diagrammatic and schematic end view of a printing-unit arrangement with information regarding diameters.

Referring now to the drawings and, first, particularly to FIG. 1 thereof, there is shown therein a printing-unit arrangement with a variety of informational data regarding diameters.

The printing unit 1 includes a form cylinder 2 having an outer cylindrical surface 3 and formed with a cavity 4. The form cylinder 2 cooperates with a rubber-blanket cylinder 6, through the intermediary of which a printing image is transferred onto stock or printing material, which is fixed on a sheet-guiding cylinder 7.

Disposed in the cavity 4 of the form cylinder 2 are a rewinding reel 9 and an unwinding reel 8 whereon, respectively, a supply of printing master 5 is taken up. The printing master 5 can be wound around the outer cylindrical surface 3 of the form cylinder 2 by means of the winding reels 8 and 9, so that, after a printing job has been completed, the section of the printing master 5 which had been previously used is accepted onto the rewinding reel 9, while a new section of printing master 5 is simultaneously wound onto the outer cylindrical surface 3 of the form cylinder 2 and can be made ready. The form cylinder 2 is provided with an axially extending opening, through which the printing master 5 is moved during the winding and unwinding of the respective reels 8 and 9. Identified on either side of the cavity by reference characters 10 and 11, respectively, are the leading and trailing ends of the print.

In the representation shown in FIG. 1, the form diameter 12 produced by the printing master 5 exceeds the cylinder-bearer diameter 13. In contrast therewith, the rubber-blanket diameter 14 is smaller than the cylinder-bearer diameter 15 of the rubber-blanket cylinder 6. Because different cylinder circumferences are thus present, and a gear-drive ratio of 1:1 exists, different circumferential speeds occur, due to which circumferential forces, i.e., shear forces, act upon the printing master 5.

Figure 2:
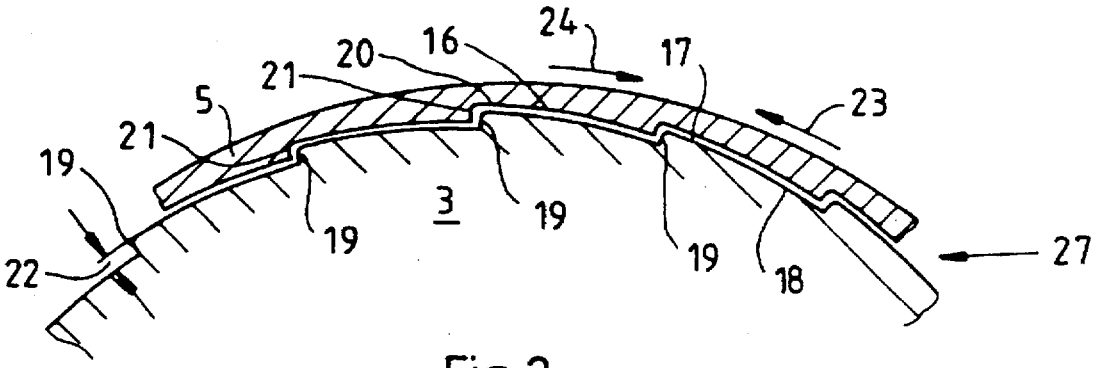
FIG. 2 is an enlarged fragmentary view of FIG. 1 showing the microstructure of a printing master and an outer cylindrical surface.

FIG. 2 is an enlarged detail of the microstructure of the rear side of a printing master 5 and the outer cylindrical surface 3 of the form cylinder 2. In this illustrated embodiment, the outer cylindrical surface 3 is shown with an extremely enlarged microstructure 27, the counterpart of which is located on the rear side of the printing master 5 in the form of a reverse structure 16. The outer cylindrical surface 3 of the form cylinder 2 is provided with a multiplicity of minute projections 17, which have both a flat flank or side 18 and a steep flank or side 19. The projections 17 produce a roughness value $R_\phi$ (step height 22) of between 10 and 15 microns on the outer cylindrical surface 3. In the illustrated embodiment, the rear side of the printing master 5 is likewise provided with a structure 16, preferably a structure complementary to the microstructure 27. During a rotation of the form cylinder 2 in the direction of the arrow 23, the steep flanks 21 of the structure 16 are in contact with the steep flanks 19 of the microstructure 27 of the outer cylindrical surface 3. No movement occurs because of the induced shear forces of the printing master 5, and the shear stresses are absorbed by the steep flanks 19 and 21, so that there is no relative movement between the printing master 5 and the outer cylindrical surface 3. Conversely, however, after a printing job has been completed and in order to change the printing portion of the printing master 5, it is very readily possible to move the printing master 5 in the unfeeling direction represented by the arrow 24 because the printing master 5 runs, with its underside, across the flat flanks 18 of the microstructure 27, it being thereby impossible for the steep flanks 19 and 21 to hook or stick to one another. The microstructure 27 thus has the function of a free-wheeling or over-running clutch, the effect of which can further be reinforced if the underside of the printing master 5 is provided with a reverse structure 16. Instead of a reverse structure 16, the underside of the printing master 5 might be coated with an elastically deformable material which adapts to the microstructure 27.

If the microstructure 27, furthermore, is disposed also at an inclined or oblique angle to the unwinding or unreeling direction of the printing master 5, lateral slippage of the printing master 5 on the outer cylindrical surface 3 of the form cylinder 2 can be prevented effectively if the form cylinder 2 is diagonally offset. Also, an imbricated or shingled microstructure 27, wherein the flanks are not continuous across the width of the cylinder, obstructs relative movement of the printing master 5. The microstructure 27 may be produced in different ways, either directly on the outer cylindrical surface 3 or on a foil 26 to be applied in a non-slip manner to the outer cylindrical surface 3 (note FIG. 3). The microstructure 27 may be produced, on the one hand, by means of an etching process or, on the other hand, by electrodeposition. The formation of a spherical cup-like textured chrome surface on the outer cylindrical surface 3 or on a foil 26 or shot-peening of the surfaces are likewise conceivable.

Figure 3:
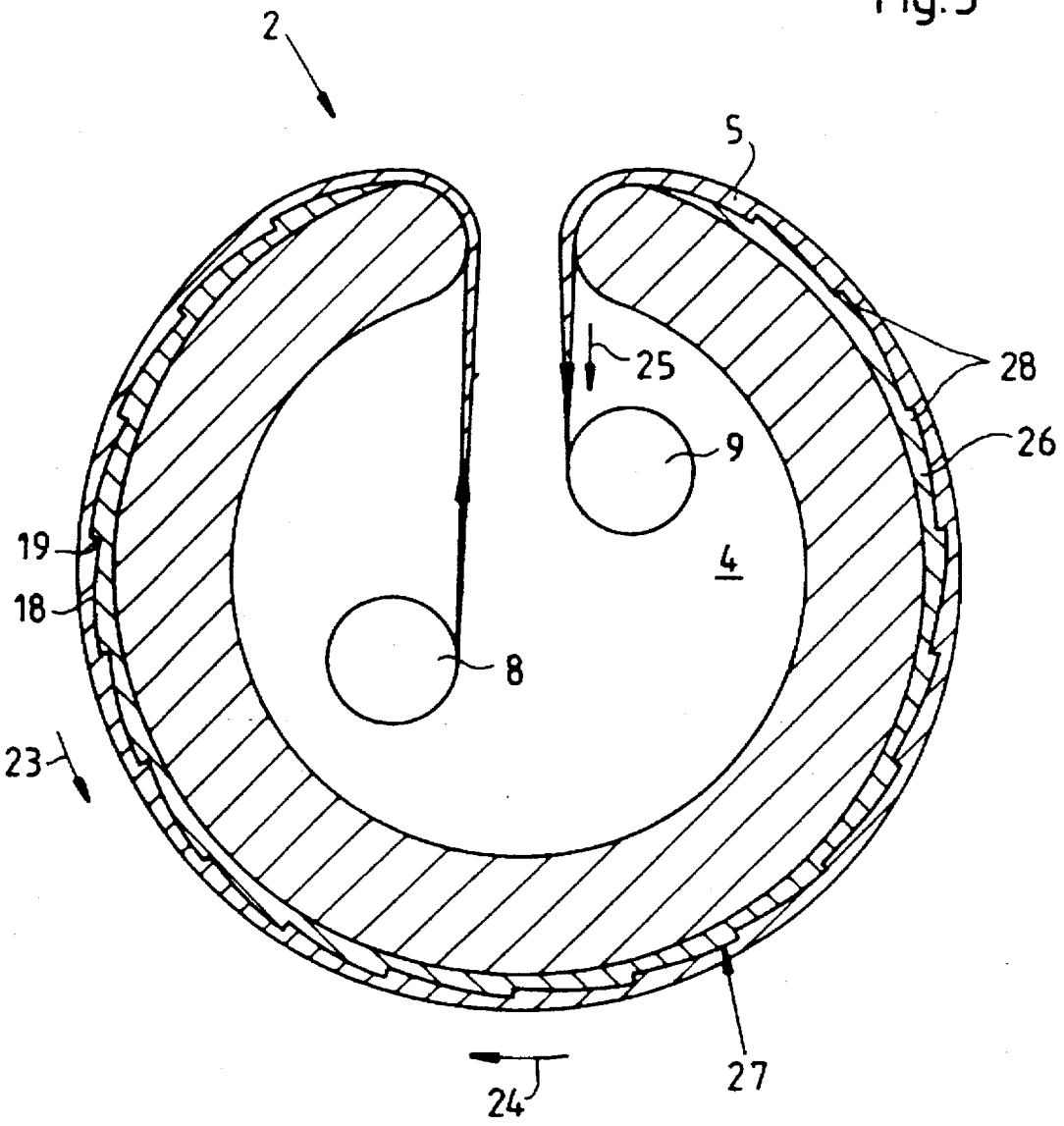
FIG. 3 is an enlarged fragmentary view of FIG. 1 showing the microstructure of a form cylinder and how a printing master or printing foil is mounted or applied in a non-slip manner to the outer cylindrical surface thereof.

The representation in FIG. 3 shows a form cylinder 2, the surface of which is provided with a fixedly mounted foil 26 which, in turn, has a microstructure 27. The microstructure 27 is formed of projections 28 which engage in recesses 20 formed on the rear side of the printing master 5. A positive form-locking connection between the printing master 5 and the foil 26 on the circumference of the form cylinder 2 is produced by the tensioning force 25 which applies tension to the printing master 5 on the circumference of the form cylinder 2 in such a manner that the steep flanks of the microstructure 27 and of the coating on the rear side of the printing master 5 stick or hook to one another and prevent any relative movement between the printing master 5 and the surface of the form cylinder 2. Accommodated in the cavity 4 of the form cylinder 2, in a manner analogous to the representation in FIG. 1, are the rewinding reel 8 as well as the unwinding reel 9 by which, on the one hand, the previously used portion of the printing master 5 can be accepted or taken up, and from which, on the other hand, the new portion of the printing master 5 to be mounted on the outer cylindrical surface can be removed.

In another embodiment or variation of the invention, the fixing of the printing master 5 is effected by providing needle-shaped gripping elements which are actuated by compressed air to project or extend out from the outer cylindrical surface 3 of the form cylinder 2 when the printing master 5 has reached the final position thereof after the unwinding or unreeling operation has been completed. The needle-shaped elements push through or penetrate beyond the outer cylindrical surface 3 of the form cylinder 2 only fractions of a millimeter and are actuated from a pressure chamber inside the form cylinder 2.

I claim:

1. A printing device, comprising: a form cylinder with an outer cylindrical surface and a cavity formed in an interior thereof, and a printing master held without slippage on the outer cylindrical surface of said form cylinder, a first reel disposed in said cavity for unwinding said printing master, and a second reel disposed in said cavity for rewinding said printing master which has been mounted on the outer cylindrical surface, said form cylinder being formed with a single opening leading to said cavity, said printing master being windable from said first reel within said cavity onto the outer cylindrical surface and from the outer cylindrical surface onto said second reel within said cavity, and means for allowing a circumferential movement of said printing master in only one direction, said means comprising a separable form-locking connection between the outer cylindrical surface of said form cylinder and said printing master for restraining circumferential movement of said printing master in a direction opposite to said one direction.

2. Printing device according to claim 1, wherein the surface provided on the form cylinder is formed with an imbricated microstructure.

3. Printing device according to claim 2, wherein the surface provided on the form cylinder is the outer cylindrical surface thereof, the microstructure being formed directly on the outer cylindrical surface of the form cylinder.

4. Printing device according to claim 2, wherein the surface provided on the form cylinder is formed on a foil fixedly mounted on the outer cylindrical surface of the form cylinder.

5. Printing device according to claim 2, wherein said microstructure is constructed of projections formed with flat flanks and steep flanks.

6. Printing device according to claim 1, wherein the printing master has a rear side formed with a structure which is a reverse of said microstructure.

7. Printing device according to claim 6, wherein said rear side of the printing master is formed with recesses defined by steep flanks.

8. Printing device according to claim 3, wherein the printing master has a rear side coated with an elastically deformable material adapting to said microstructure of the outer cylindrical surface of the form cylinder.

9. Printing device according to claim 4, wherein the printing master has a rear side coated with an elastically deformable material adapting to said microstructure of said foil.

10. Printing device according to claim 1, wherein the printing master has a rear side coated with tetrafluoroethylene.

* * * * *